US006429726B1

(12) United States Patent
Bruneau et al.

(10) Patent No.: US 6,429,726 B1
(45) Date of Patent: Aug. 6, 2002

(54) ROBUST FORWARD BODY BIAS GENERATION CIRCUIT WITH DIGITAL TRIMMING FOR DC POWER SUPPLY VARIATION

(75) Inventors: David W. Bruneau, Milwaukie; Siva G. Narendra; Vivek K. De, both of Beaverton, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/820,067

(22) Filed: Mar. 27, 2001

(51) Int. Cl.[7] ..... G05F 3/24
(52) U.S. Cl. ..... 327/537
(58) Field of Search ..... 327/534, 535, 327/537

(56) References Cited

U.S. PATENT DOCUMENTS 5,017,811 A * 5/1991 Worley ..... 327/543
5,397,934 A * 3/1995 Merrill et al. ..... 327/537
5,834,966 A * 11/1998 So et al. ..... 327/534
5,883,544 A * 3/1999 So et al. ..... 327/537
5,939,934 A * 8/1999 So et al. ..... 327/534
6,052,020 A 4/2000 Doyle ..... 327/539

* cited by examiner

*Primary Examiner*—Timothy P. Callahan
*Assistant Examiner*—Terry L. Englund
(74) *Attorney, Agent, or Firm*—Blakely, Sokoloff, Taylor & Zafman LLP

(57) ABSTRACT

A method and apparatus provide a forward body bias (FBB) according to various embodiments, in which a supply voltage is divided into a number of dc voltages. One of these voltages is selected as a function of the supply voltage (as measured between a power supply line and a power return line). A constant FBB is generated based upon the selected dc voltage and applied to each bulk terminal of at least some of the field effect transistors (FETs) of a given conductivity type in a functional unit block (FUB) of an integrated circuit die.

18 Claims, 3 Drawing Sheets

| POWER SUPPLY CODE | $V_{DD} - V_{SS}$ | OUTPUT 1 (SOURCE OF FBB FOR PFETs) | OUTPUT 2 (SOURCE OF FBB FOR NFETs) |
|---|---|---|---|
| 1 | 1.6 - 2.0 | $V_a$ | Vc |
| 2 | 1.2 - 1.6 | $V_d$ | Ve |
| 3 | 0.8 - 1.2 | $V_b$ | Vb |
| 4 | 0.6 - 0.8 | $V_e$ | Vd |

ROBUST FORWARD BODY BIAS GENERATION CIRCUIT WITH DIGITAL TRIMMING FOR DC POWER SUPPLY VARIATION

BACKGROUND

This invention is generally related to the generation of a forward body bias (FBB) voltage for field effect transistors (FETs), and particularly to robust generation circuits that maintain a constant FBB despite variations in the manufacturing process, the operating temperature, and supply voltage.

Forward body biasing reduces process induced variations in short channel field effect transistors (FETs). N-channel FETs (NFETs) have sources, drains, and bodies (also known as bulks) with voltages Vsource, Vdrain, and Vbody. N-channel metal oxide semiconductor field effect transistors (NMOSFETs) are examples of NFETs. NFETs are zero body biased when Vbody=Vsource, reverse body biased when Vbody<Vsource, and forward body biased when Vbody>Vsource. The amount of FBB for NFETs is measured by Vbody−Vsource, which equals Vbody when Vsource is at ground on a return line voltage (sometimes referred to as Vss). P-channel FETs (PFETs) have sources, drains, and bodies with voltages Vsource, Vdrain, and Vbody. P-channel channel metal oxide semiconductor field effect transistors (PMOSFETs) are examples of PFETs. PFETs are zero body biased when Vbody=Vsource, reverse body biased when Vbody>Vsource, and forward body biased when Vbody<Vsource. The amount of FBB for PFETs is measured by Vsource Vbody, Vbody which equals Vcc−Vbody in cases where Vsource is at the power supply line voltage Vcc (sometimes referred to as Vdd).

The threshold voltage (Vt) of a FET decreases as the FET becomes more forward biased and increases as the FET becomes less forward biased or more reverse biased. The leakage of a FET increases as the FET becomes more forward biased and decreases as the FET becomes less forward biased or more reverse biased.

Circuits that provide stable voltage references independent of manufacturing process, power supply voltage and operating temperature are needed for many applications, including accurate FBB generation. Among the techniques available for realizing a voltage reference are the use of zener diodes, the use of the difference in threshold voltage between enhancement and depletion FETs, and bandgap-based circuits. The first two methods are not suitable for complex, advanced integrated circuits (ICs) because the breakdown voltage of the zener diode is significantly higher than the supply voltages used to operate such ICs. Depletion FETs may not be available in complimentary metal oxide semiconductor (CMOS) IC fabrication processes. Because of these limitations, bandgap circuits are used extensively. Although bandgap reference circuits are extremely accurate, they are complex and demand considerable design time.

In applications such as FBB generation in CMOS ICs, a complimentary pair of FBB reference voltages often needs to be provided, where one is measured with respect to the power supply voltage (e.g. Vdd or Vcc) and the other is measured with respect to the power return voltage (Vss or ground). The voltage with respect to Vdd, called Vrefc, is applied to a PFET whereas the voltage with respect to Vss, called Vrefs, is applied to an NFET. Thus, for a PFET whose source is shorted to Vdd, a FBB of approximately 0.4 Volts is obtained by setting the bulk terminal of the device to Vrefc which is 0.4 Volts less than Vdd. In the same way, for an NFET whose source is shorted to Vss, the FBB of 0.4 Volts is applied by setting the bulk terminal to Vrefs which is 0.4 Volts greater than Vss. One limited solution for generating Vrefc and Vrefs is to build a separate generator for each. That, however, requires double the area, power, and circuit design effort, and is therefore an inefficient solution.

BRIEF DESCRIPTION OF THE DRAWINGS

The invention is illustrated by way of example and not by way of limitation in the figures of the accompanying drawings in which like references indicate similar elements. It should be noted that references to "an" embodiment in this disclosure are not necessarily to the same embodiment, and they mean at least one.

DETAILED DESCRIPTION

A method for providing a forward body bias (FBB) is described according to various embodiments, in which a supply voltage is divided into a number of dc voltages. One of these voltages is selected as a function of the supply voltage (as measured between a power supply line and a power return line). A constant FBB is generated based upon the selected dc voltage and applied to each bulk terminal of at least some of the field effect transistors (FETs) of a given conductivity type in a functional unit block (FUB) of an integrated circuit die. An advantage to such a technique is that it provides a simpler circuit design task than, for instance, a bandgap reference based generator, while at the same time providing an adequate level of robustness as a function of variations in temperature and manufacturing process parameters. Although a bandgap reference based generator allows a much more robust and accurate FBB to be generated in the presence of power supply voltage variation, some variation in FBB may be tolerated in many applications. According to certain embodiments of the invention, this relatively small amount of power supply induced variation in the FBB is limited using a 'digital trimming' technique in which an appropriate one of several dc voltages (available from the dividers) is selected as a function of a power supply code. An advantage here is that the technique is easily scaled to provide a second FBB for FETs that have an opposite conductivity type, by further selecting one of the dc voltages to generate the second constant FBB. The supply induced variation in FBB may be reduced by dividing the supply voltage into a larger number and more varied set of dc voltages, such that the voltage selection can be done with finer granularity.

Figure 1:
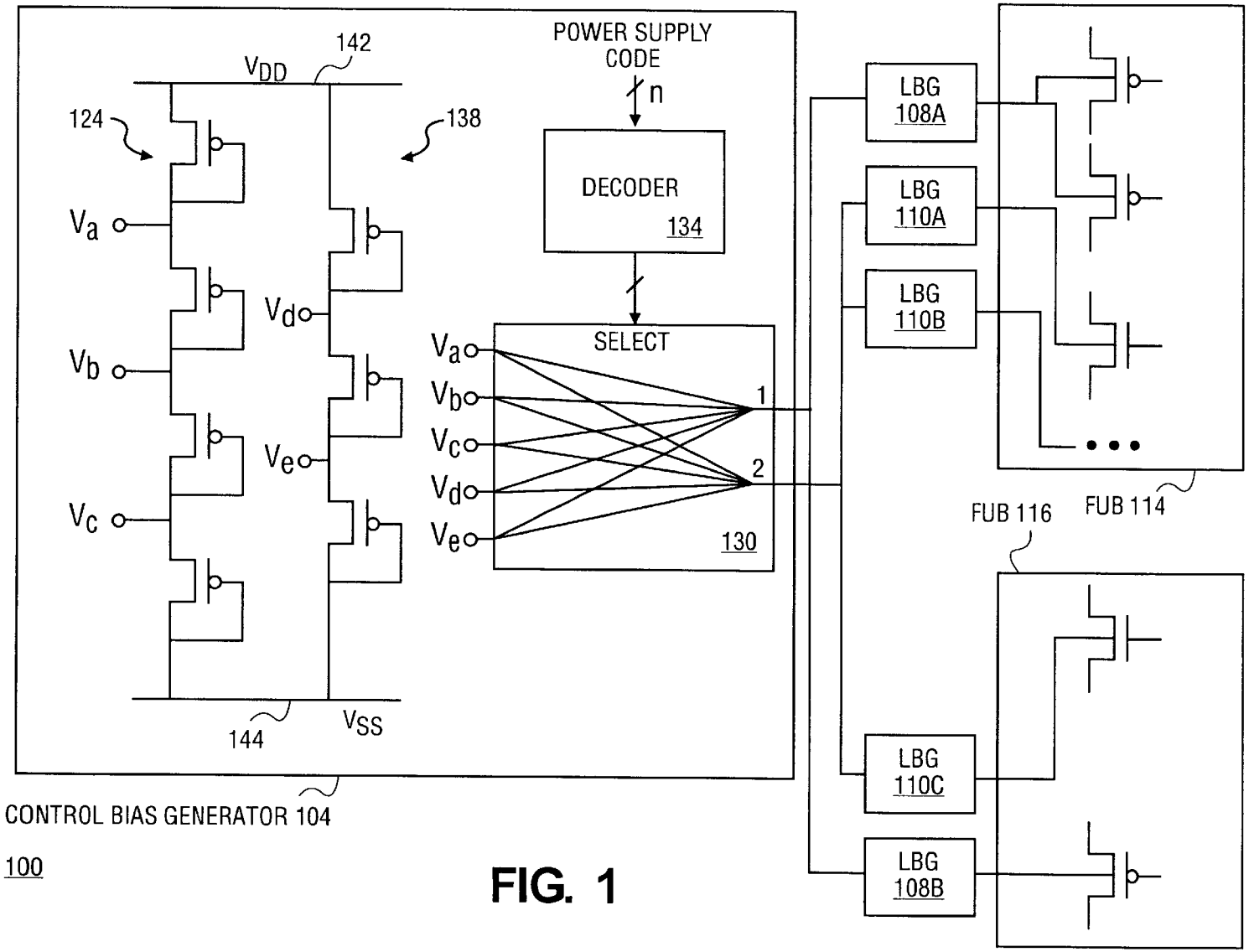
FIG. 1 depicts a block diagram of an electrical system according to some embodiments of the invention.

Referring now to FIG. 1, an electrical system 100 is shown in block diagram form that is equipped with a central bias generator (CBG) 104 and a number of local bias generators (LBGs) 108 and 110. The CBG 104 at a first output provides a selected one of a number of dc voltages Va, Vb, . . . Ve to each of the LBGs 108*a* and 108*b*. In addition, the CBG may (if desired) provide at a second output a further selected one of the dc voltages to each of LBGs 110*a*, 110*b*, and 110*c*. There may be two types of LBGs. The 108 series are designed to translate an input selected dc voltage to a voltage that is applied to the bulk of PFETs, whereas the 110 series are designed to generate the bulk voltage for NFETs. For example, FIG. 1 shows that LBG 108*a* has an output that feeds the bulk terminals of two PFETs in the FUB 114 while another LBG (108*b*) feeds a PFET in FUB 116. In contrast, LBGs 110*a*, 110*b*, and 110*c* provide the constant FBB to NFETs in FUBs 114 and 116. More generally, a wide range of different topologies are contemplated that allow two selected dc voltages from the CBG 104 to be used to generate the constant FBBs for NFETs and PFETs in an electrical system.

The LBGs may range from a simple buffer or low impedance path (such as a wire) that duplicates the input selected dc voltage at its output, to much more complex signal conditioning circuitry that may include level shifting the input selected dc voltage to a desired level for a given FET. The more sophisticated types of LBGs may also be configured to operate with different supply voltages than the FUBs. In one case, the CBG 104, the LBGs 108 and 110, and the FUBs 114 and 116 are all operating under the same power supply voltage Vdd−Vss. Sometimes, however, the FUBs and LBGs may be designed to operate at different power supply voltages than the CBG. In such a case, the LBGs 108 and 110 will serve to translate between the power supply of the CBG 104 and that of the FUBs, such that the correct FBB is provided to the desired FETs in a FUB.

A FUB is any group of circuitry (on one or more IC dies) that is designed to impart a certain logic or mixed signal (analog/digital) functionality to the electrical system. The FUB may be manufactured using an entirely CMOS process in which all of the active devices are FETs, or it may alternatively be manufactured using a Bipolar-MOS process in which other transistors in addition to FETs are also provided. In general, there is some flexibility in the physical placement of the CBG, LBGs, and FUBs. In most advanced CMOS ICs, however, all three components are most likely to be formed on the same IC die for lower cost and better performance.

Returning now to the CBG 104, this circuit has first and second voltage dividers 124 and 138 that provide a number of dc voltages (in this example, 5 dc voltages labeled Va, Vb, . . . Ve). Switch circuitry 130 has a number of inputs corresponding to the number of dc voltages available from the dividers, where each input receives a respective voltage from the divider. The switch circuitry 130 has at least one output to provide, via a switched low impedance path, a selected one of the input dc voltages. The outputs may be buffered to increase fanout. A decoder 134 is provided with one or more outputs that are coupled to control the switch circuitry 130 to route a selected one of the input dc voltages to the output of switch circuitry 130. This is done in response to an input code of n bits that represents a power supply voltage Vdd−Vss of the system. Thus, according to the input power supply code, the decoder 134 causes one of the dc voltages Va, Vb, . . . to be routed through a low impedance path, to an output of the switch circuitry 130.

In those embodiments in which the switch circuitry 130 has a second output, the decoder 134 and switch circuitry 130 may be configured such that the same power supply code results in a further dc voltage to be selected and provided at the second output. The LBGs 110 that are coupled to the second output provide a second, constant FBB to FETs that have an opposite conductivity type as those that are biased by LBGs 108. Although the system 100 shown in FIG. 1 has the capability for providing FBB to both NFETs and PFETs, through the use of two separate outputs of the switch circuitry 130, other systems may only require one type of FBB such that only a single output from the switch circuitry 130 is sufficient.

The particular embodiment of the electrical system 100 shown in FIG. 1 has a CBG 104 with two dividers 124 and 138. The use of a second voltage divider with an odd number of elements (as compared to the first divider 124 which has an even number of elements) allows not just a larger selection of dc voltages but also a more efficient way to generate the desired FBB. As mentioned above, a greater number of and more varied set of dc voltages available from the dividers 124 and 138 allows finer control of the dc voltage that is provided to the LBGs 108 and 110, which means that a lower power supply induced variation can be obtained. This will be explained below in connection with FIGS. 2–4. Although the embodiment in FIG. 1 shows the CBG 104 with two voltage dividers 124 and 138, in general the CBG 104 may have one or more dividers, depending upon the permitted complexity in the design of the CBG 104 as well as the degree of variation as a function of supply voltage that can be tolerated in the FBB.

As to temperature and process variations, one way to ensure that the output of the CBG 104 exhibits minimal variation as a function of temperature and manufacturing process parameters is to have the circuit elements of the voltage dividers be matched or essentially identical, and arranged close to each other on the same IC die. In this way, the variation in the dc voltages provided by the dividers, as a function of temperature or manufacturing process parameters, are minimized. However, this CBG 104 may not exhibit the same precision and robustness that a bandgap reference can provide in view of power supply voltage.

Figures 2, 3:
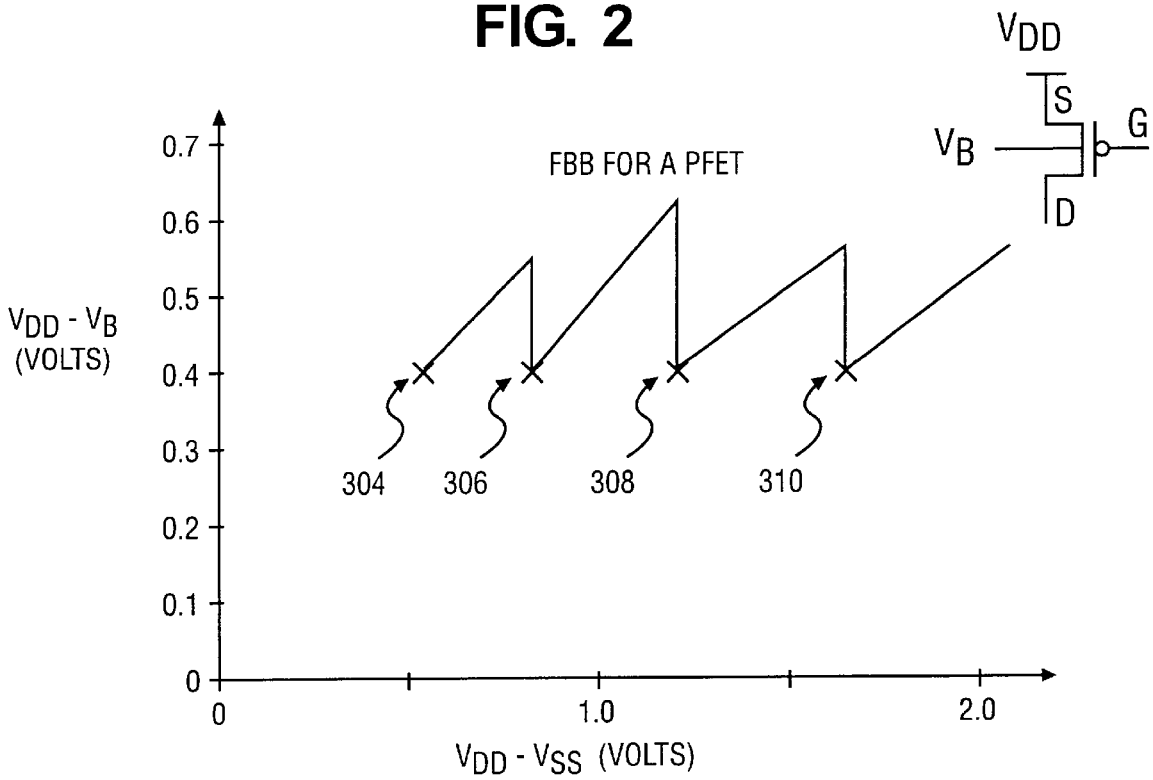
FIG. 2 shows a lookup table that matches a particular leg of a voltage divider to a given power supply code, for use in some embodiments of the invention.
FIG. 3 illustrates a plot of the variation in FBB to a PFET as a function of power supply voltage, according to some embodiments of the invention.

Turning now to FIG. 2, an exemplary variation in power supply voltage Vdd−Vss, i.e. the voltage between supply line 142 and return line 144 in FIG. 1, and the appropriate selection of the dc voltage source for generating an FBB of approximately 0.4 volts is shown. In effect, this may be viewed as a lookup table which identifies the source of FBB for the particular type of FET, as a function of the approximate range of voltages in which the power supply is expected to operate or at which it is operating.

For a power supply code 4, which corresponds to a power supply voltage Vdd−Vss between 0.6 to 0.8 volts, the first output of the switch circuitry (which provides the source of FBB for PFETs) exhibits the selected voltage Ve. This corresponds to point 304 in the plot of FIG. 3. It can be seen that as the power supply voltage increases from 0.6 volts to 0.8 volts, Ve (and therefore the FBB for the PFET whose source is shorted to Vdd) increases until approximately 0.53 volts. At this point, the power supply voltage is about to move into the next higher range, from 0.8 to 1.2 volts, which corresponds to a power supply code 3. The transition from power supply code 4 to power supply code 3 is at point 306 of the plot where the selected dc voltage changes from Ve to Vb. Referring momentarily to FIG. 1, it can be seen that when the power supply voltage is at 0.8 volts, Vb is 0.4 volts assuming that all four of the stacked diode connected PFETs in the divider 124 are essentially identical.

As the power supply voltage increases from 0.8 volts, the FBB also increases from 0.4 volts to a maximum of approximately 0.6 volts when the supply is at 1.2 volts. Here there is a transition from power supply code 3 to power supply code 2, such that the first output of the switch circuitry changes from Vb to Vd (see FIG. 2). The effect of this change is that the FBB is reduced back to 0.4 volts, at point 308 in FIG. 3. As the power supply voltage increases beyond 1.2 volts, the FBB also increases from 0.4 volts to approximately 0.53 volts which occurs when the power supply voltage is at 1.6 volts. Above 1.6 volts, the power supply code changes from 2 to 1 and accordingly the output of the switch circuitry changes from Vd to Va. This occurs at point 310 in the plot of FIG. 3 where the FBB drops back down to 0.4 volts. Thus, as the power supply voltage changes, different taps on the voltage dividers 124 and 138 are selected automatically or manually, to limit the variation in the FBB. As was mentioned above, the variation in FBB between 0.4 and 0.5 volts may be acceptable in many applications, such that the increased complexity and cost of a very precise bandgap reference is avoided using, for instance, an embodiment of the CBG 104 shown in FIG. 1.

Figure 4:
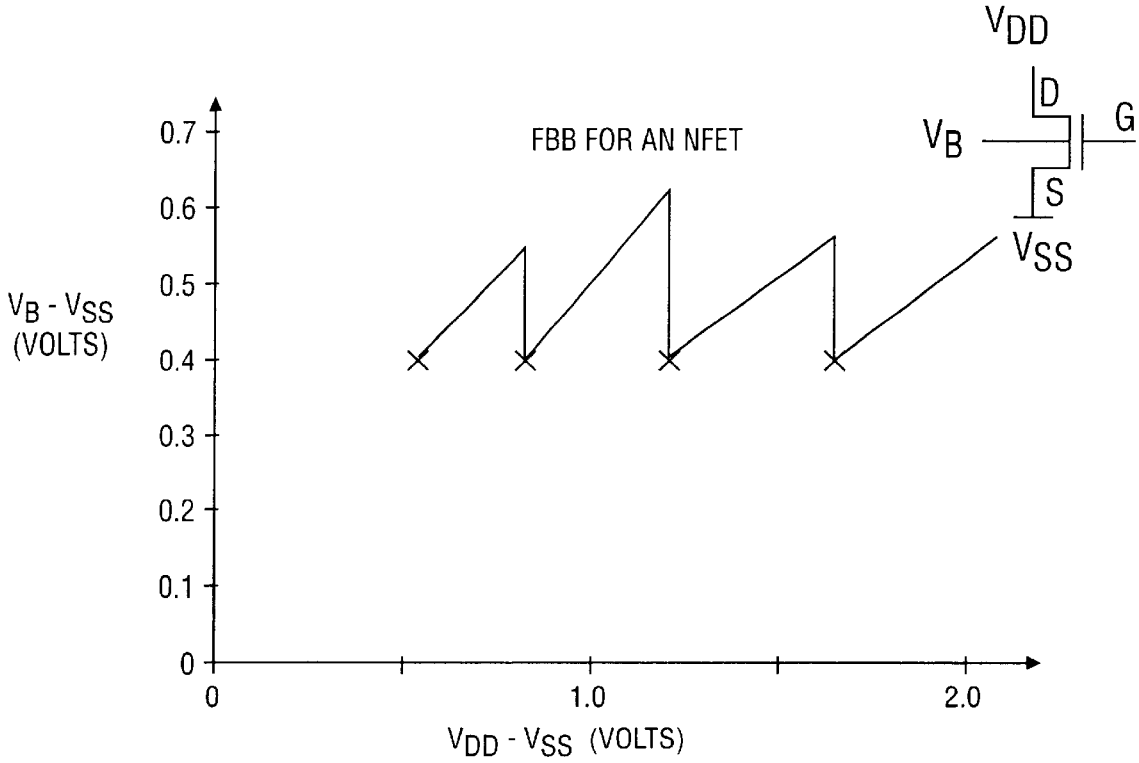
FIG. 4 depicts a plot of the variation in FBB provided to an NFET as a function of power supply voltage, according to some embodiments of the invention.

FIG. 4 illustrates a plot of FBB for an NFET whose source terminal is shorted to the power supply return line (at Vss). The plot for FBB as a function of power supply voltage results from the sequence of selected dc voltages shown in FIG. 2 as the power supply changes from 0.6 volts to 2.0 volts. Again, note the variation between 0.4 and 0.5 volts as a function of the supply voltage. More generally, this amount of variation may be controlled by designing the voltage dividers 124 and 138 with the appropriate number of stacked elements such that, for instance, for finer control of the variation in FBB, a larger number of taps are available for the decoder 134 to select. The increased number of taps on the voltage dividers may be combined with a larger number of power supply codes where each code represents a smaller range of variation in power supply voltage than the one shown in FIG. 2. There is a trade off here of lower variation (as a function of supply voltage) for increased complexity of the voltage divider, the switch circuitry, and the decoder.

Figure 5:
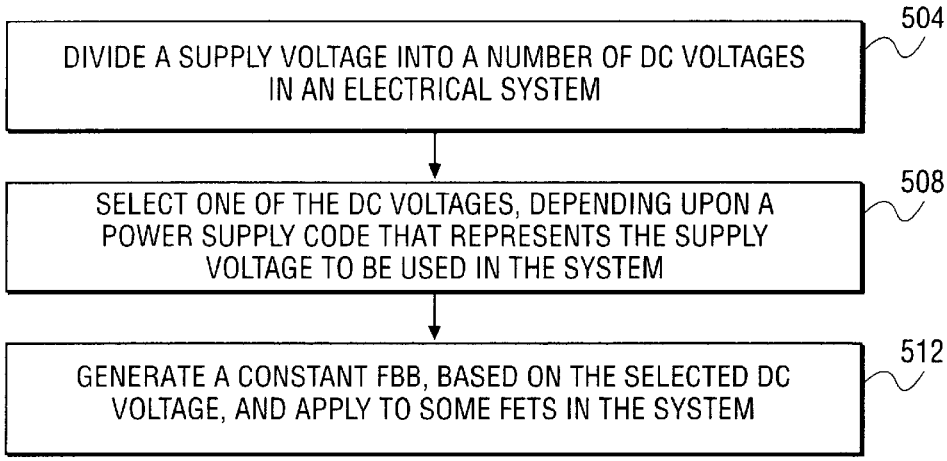
FIG. 5 shows a flow diagram of operations in providing FBB to an NFET or PFET in an electrical system, according to some embodiments of the invention.

Turning now to FIG. 5, a flow diagram of operations to be performed in generating the constant FBB according to certain embodiments of the invention is illustrated. Operation begins with a supply voltage being divided into a number of dc voltages in an electrical system (block 504). One of the dc voltages, depending upon a power supply code that represents the supply voltage in the system, is selected (block 508). The updated power supply code may be obtained automatically by the system in response to detecting a change in the power supply voltage or by automatically detecting a change in a hardware jumper setting. As another alternative, the updated power supply code may be manually configured by, for instance, a user through software control or other mechanisms for signaling the desired change in the power supply setting. In all of these cases, a constant FBB is generated, based upon the selected dc voltage, and applied to one or more FETs in the system (block 512). As mentioned above, the generation of the constant FBB may involve a simple forwarding of the selected dc voltage through a low impedance path or it may involve some form of signal conditioning including voltage level translation if needed in view of the power supply to which the receiving FET is coupled or in view of the drain and source voltages to which the receiving FET is being subjected. To summarize,various embodiment of the invention have been described that are directed to an improved technique for generating a bias voltage, in particular a FBB. In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. An electrical system comprising:

a functional unit block (FUB) including field effect transistors (FETs), each FET having source, drain, gate and bulk terminals;

a central bias generator having a first voltage divider coupled between a power supply line and a power return line to provide a plurality of first dc voltages, switch circuitry having a plurality of inputs coupled to the voltage divider and a first output to provide a selected one of the first dc voltages, and a decoder having one or more outputs coupled to control the switch circuitry in response to an input code that represents a power supply voltage between the supply line and the return line; and a plurality of first local bias generators each being coupled to the first output to provide a first constant forward body bias (FBB), in response to the selected dc voltage, to each bulk terminal of at least some of the FETs.

2. The electrical system of claim 1 wherein the first voltage divider is made of a plurality of essentially identical circuit elements stacked between the supply and return lines.

3. The electrical system of claim 2 wherein the plurality of essentially identical circuit elements are diode-connected FETs.

4. The electrical system of claim 1 wherein the central bias generator further comprises a second voltage divider to provide one or more second dc voltages, the switch circuitry being further coupled to the second voltage divider to provide at the first output a selected one of the first and second dc voltages.

5. The electrical system of claim 1 wherein the switch circuitry has a second output to provide a selected one of the first dc voltages, the system further comprising:

a plurality of second local bias generators each being coupled to the second output to provide a second constant FBB, in response to the selected dc voltage, to at least some of the FETs that do not receive the first constant FBB.

6. The electrical system of claim 5 wherein the FETs that receive the first constant FBB are n-channel devices and the FETs that receive the second constant FBB are p-channel devices.

7. The electrical system of claim 6 wherein the central bias generator further comprises a second voltage divider to provide one or more second dc voltages, the switch circuitry being further coupled to the second voltage divider to provide (1) at the first output, a selected one of the first and second dc voltages, and (2) at the second output, a selected one of the first and second dc voltages.

8. The electrical system of claim 4 wherein the second voltage divider is made of a plurality of essentially identical circuit elements stacked between the supply and return lines.

9. The electrical system of claim 3 wherein the diode-connected FETs are p-channel devices.

10. The electrical system of claim 7 wherein the FUB, the central bias generator, and the plurality of local bias generators are formed on the same integrated circuit die.

11. The electrical system of claim 1 wherein at least one of the first local bias generators is a fixed low impedance path.

12. A method for providing forward body bias (FBB), comprising:

dividing a power supply voltage into a plurality of dc voltages;

selecting one of the dc voltages as a function of the supply voltage; and generating a first constant FBB based upon the selected dc voltage and applying the first constant FBB to each bulk terminal of at least some field effect transistors (FETs) of a first conductivity type in a functional unit block (FUB) of an integrated circuit die.

13. The method of claim 12 further comprising:

further selecting one of the dc voltages; and generating a second constant FBB based upon the further selected dc voltage and applying the second constant FBB to each bulk terminal of at least some FETs of a second conductivity type opposite the first type in the FUB.

14. The method of claim 12 wherein generating the first constant FBB includes forwarding the selected dc voltage through a low impedance path to each bulk terminal.

15. An electrical system comprising:

means for dividing a supply voltage into two or more first dc voltages;

means for selecting two of the one or more first dc voltages as a function of the supply voltage; and means for generating a first constant forward body bias (FBB) based upon the selected first dc voltage and applying the first constant FBB to each bulk terminal of at least some field effect transistors (FETs) in a functional unit block (FUB) of an integrated circuit die.

16. The electrical system of claim 15 further comprising:

means for dividing the supply voltage into one or more second dc voltages, wherein the selection means is to select one of the first and second dc voltages as a function of the supply voltage.

17. The electrical system of claim 15 further comprising:

means for further selecting one of the first dc voltages; and means for generating a second constant FBB based upon the further selected dc voltage and applying the second constant FBB to each bulk terminal of at least some FETs in the FUB that do not receive the first constant FBB.

18. The electrical system of claim 17 further comprising:

means for dividing the supply voltage into one or more second dc voltages, and wherein the further selection means is to select one of the first and second dc voltages as a function of the supply voltage.

* * * * *

UNITED STATES PATENT AND TRADEMARK OFFICE

CERTIFICATE OF CORRECTION

PATENT NO. : 6,429,726 B1
DATED : August 6, 2000
INVENTOR(S) : Bruneau et al.

It is certified that error appears in the above-identified patent and that said Letters Patent is hereby corrected as shown below:

Column 1,
Line 26, after “P-channel”, delete “channel”.
Line 31, delete “Vsource Vbody, Vbody”, insert -- Vsource – Vbody, --.

Column 7,
Line 23, delete “two of the one”, insert -- one of the two --.

Signed and Sealed this

Eighteenth Day of February, 2003

JAMES E. ROGAN
*Director of the United States Patent and Trademark Office*